US007543364B1

(12) United States Patent
Price et al.

(10) Patent No.: US 7,543,364 B1
(45) Date of Patent: Jun. 9, 2009

(54) BORDER FLANGING AND ATTACHMENT GUSSET FORMING SYSTEM

(75) Inventors: Elvin C. Price, Decula, GA (US); Preston B. Dasher, Lawrenceville, GA (US); Warren G. Oxley, Auburn, GA (US); Jesse L. Morrison, Lawrenceville, GA (US); Robert R. Paust, Loganville, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 672 days.

(21) Appl. No.: 11/034,472

(22) Filed: Jan. 13, 2005

Related U.S. Application Data

(60) Provisional application No. 60/536,325, filed on Jan. 13, 2004, provisional application No. 60/545,514, filed on Feb. 17, 2004, provisional application No. 60/549,584, filed on Mar. 3, 2004, provisional application No. 60/553,510, filed on Mar. 16, 2004.

(51) Int. Cl.
*B68G 7/10* (2006.01)

(52) U.S. Cl. ..... 29/91.6; 29/91.1; 112/2.1

(58) Field of Classification Search ..... 29/91, 29/91.1, 91.6; 112/2.1, 120, 141, 147, 475.06, 112/475.07, 470.33
See application file for complete search history.

(56) References Cited

U.S. PATENT DOCUMENTS

| | | | | |
|---|---|---|---|---|
| 1,947,058 | A | 2/1934 | Pittoni | 112/3 |
| 3,013,513 | A | 12/1961 | Judelson | 112/203 |
| 3,490,061 | A | 1/1970 | Docker | 112/2.1 |
| 3,641,954 | A | 2/1972 | Kalning et al. | 112/3 |
| 3,824,964 | A | 7/1974 | Ryan | 223/30 |
| 4,013,026 | A | 3/1977 | Hall | 112/153 |
| 4,043,282 | A | 8/1977 | Fanghanel | 112/3 |
| 4,061,327 | A | 12/1977 | Blessing | 270/78 |
| 4,067,269 | A | 1/1978 | Fanghanel | 112/3 |
| 4,115,886 | A | 9/1978 | Miller | 5/365 |
| 4,141,304 | A | 2/1979 | Masuda | 112/153 |
| 4,290,376 | A | 9/1981 | Brusasca et al. | 112/121.26 |
| 4,460,350 | A | 7/1984 | Mittal et al. | 493/412 |
| 4,462,129 | A | 7/1984 | Brannock | 5/474 |
| 4,463,466 | A | 8/1984 | May et al. | 5/475 |
| 4,498,404 | A | 2/1985 | Sadeh | 112/121.12 |
| 4,691,651 | A | 9/1987 | Junemann | 112/259 |
| 4,703,706 | A | 11/1987 | Plante | 112/265.1 |
| 4,742,789 | A | 5/1988 | Pestel et al. | 112/262.3 |

(Continued)

FOREIGN PATENT DOCUMENTS

| | | | |
|---|---|---|---|
| DE | 31 39426 | A1 | 4/1983 |

(Continued)

*Primary Examiner*—David P Bryant
*Assistant Examiner*—Christopher M Koehler
(74) *Attorney, Agent, or Firm*—Womble Carlyle Sandridge & Rice, PLLC

(57) ABSTRACT

A process and apparatus for forming a mattress. A border material is fed through a sewing station to form a hem. The same material is fed through the sewing station again, at a different elevation to form a second hem and an attachment gusset. The hemmed gusset and border material then is preferably subjected to a ruffling process to form a series of pleats about the corners of the mattress border. The perimeter of the border is then closed, and the finished border is placed over a set of mattress springs and fixed in place.

18 Claims, 9 Drawing Sheets

U.S. PATENT DOCUMENTS

| | | | | | |
|---|---|---|---|---|---|
| 4,776,579 | A | | 10/1988 | Romand et al. | 271/228 |
| 4,794,873 | A | | 1/1989 | Dordi et al. | 112/2.1 |
| 4,813,364 | A | | 3/1989 | Boser | 112/304 |
| 4,821,656 | A | | 4/1989 | Dordi et al. | 112/2.1 |
| 4,825,787 | A | | 5/1989 | Babson et al. | 112/262.3 |
| 4,827,856 | A | | 5/1989 | Rohr | 112/63 |
| 4,838,186 | A | | 6/1989 | Resta et al. | 112/2.1 |
| 4,905,615 | A | | 3/1990 | Pofferi | 112/2.1 |
| 4,958,579 | A | | 9/1990 | De Weers | 112/2.1 |
| 4,998,965 | A | | 3/1991 | Easom | 112/305 |
| 5,018,462 | A | | 5/1991 | Brocklehurst | 112/121.12 |
| 5,042,098 | A | | 8/1991 | Stultz | 5/495 |
| 5,145,144 | A | | 9/1992 | Resta et al. | 248/637 |
| 5,185,897 | A | | 2/1993 | Van Laanen | 5/455 |
| 5,282,433 | A | | 2/1994 | Freermann et al. | 112/153 |
| 5,289,788 | A | | 3/1994 | Fukumoto | 112/121.12 |
| 5,341,755 | A | | 8/1994 | Kawasaki | 112/263 |
| 5,367,968 | A | | 11/1994 | Diaz | 112/262.3 |
| 5,483,909 | A | | 1/1996 | Nogueras | 112/475.04 |
| 5,501,164 | A | * | 3/1996 | Porter et al. | 112/176 |
| 5,511,500 | A | * | 4/1996 | Conley, Jr. | 112/470.05 |
| 5,529,004 | A | | 6/1996 | Porter et al. | 112/470.03 |
| 5,537,699 | A | | 7/1996 | Bonaddio et al. | 54/474 |
| 5,560,308 | A | | 10/1996 | Eto | 112/470.07 |
| 5,586,511 | A | | 12/1996 | Porter et al. | 112/2.1 |
| 5,617,802 | A | | 4/1997 | Cash | 112/117 |
| 5,647,293 | A | | 7/1997 | Price et al. | 112/470.17 |
| 5,655,241 | A | | 8/1997 | Higgins et al. | 5/737 |
| 5,694,875 | A | * | 12/1997 | Cash | 112/470.12 |
| 5,704,084 | A | | 1/1998 | Evans et al. | 5/710 |
| 5,782,190 | A | | 7/1998 | Porter et al. | 112/176 |
| 5,809,919 | A | | 9/1998 | Mitchell et al. | 112/470.07 |
| 5,816,177 | A | | 10/1998 | Brocklehurst | 112/470.05 |
| 5,881,656 | A | | 3/1999 | Grant | 112/2.11 |
| 5,915,319 | A | | 6/1999 | Price et al. | 112/470.16 |
| 5,970,548 | A | | 10/1999 | Welch | 5/710 |
| 6,000,352 | A | | 12/1999 | Porter et al. | 112/470.12 |
| 6,055,921 | A | | 5/2000 | Olewicz et al. | 112/475.07 |
| 6,125,488 | A | | 10/2000 | Vogland et al. | 5/739 |
| 6,202,579 | B1 | | 3/2001 | Olewicz et al. | 112/2.1 |
| 6,209,468 | B1 | | 4/2001 | Marcangelo et al. | 112/475.06 |
| 6,293,213 | B1 | | 9/2001 | Block et al. | 112/470.5 |
| 6,397,768 | B1 | | 6/2002 | Dasher et al. | 112/2.11 |
| 6,532,608 | B2 | | 3/2003 | Schreiner | 5/497 |
| 6,574,815 | B2 | | 6/2003 | Freeman et al. | 5/716 |
| 2001/0032361 | A1 | | 10/2001 | Schreiner | 5/497 |
| 2002/0050117 | A1 | | 5/2002 | Dasher et al. | 53/117 |
| 2002/0144352 | A1 | * | 10/2002 | Freeman et al. | 5/716 |

FOREIGN PATENT DOCUMENTS

| | | | |
|---|---|---|---|
| DE | 37 12493 | A1 | 5/1987 |
| EP | 0264 618 | A1 | 4/1988 |
| EP | 0 330 285 | B1 | 2/1989 |
| EP | 0 200 368 | B1 | 10/1990 |
| EP | 0682135 | | 11/1995 |
| FR | 1567893 | | 9/1967 |
| GB | 1384073 | | 2/1975 |
| JP | 7308465 | | 11/1995 |
| WO | WO 92/12282 | | 7/1992 |
| WO | WO 95/25194 | | 9/1995 |
| WO | WO 02/065877 | | 8/2002 |

* cited by examiner

BORDER FLANGING AND ATTACHMENT GUSSET FORMING SYSTEM

CROSS REFERENCE TO RELATED APPLICATIONS

This application claims the benefit of the following U.S. provisional patent applications: 60/536,325, filed Jan. 13, 2004 (Price, et al., Border Flanging and Attachment Gusset Forming System); 60/545,514, filed Feb. 17, 2004 (Price, et al., Border Flanging and Attachment Gusset Forming System); 60/549,584, filed Mar. 3, 2004 (Price, et al., Border Flanging and Attachment Gusset Forming System); and 60/553,510, filed Mar. 16, 2004 (Price, et al., Border Flanging and Attachment Gusset Forming System). All of the foregoing provisional patent applications are hereby incorporated by reference in their entirety.

FIELD OF THE INVENTION

The present invention relates to sewing systems, and in particular, to a system and a method for forming mattress borders having pillowtop attachment gussets and flanging material applied thereto.

BACKGROUND OF THE INVENTION

In recent years, the construction of mattresses has undergone significant changes to meet consumer demands for increased comfort and greater choices in their mattresses. As a result, consumers now have a number of different styles, with different features, of mattresses to choose from, including mattresses having varying amounts of stability or rigidity to provide a "soft" or "hard" feel, double sided mattresses, and similar choices. Pillowtop mattresses have become especially popular for providing additional cushioning for the mattresses with the amount of cushioning for a pillowtop mattresses being variable from relatively thin, flat layers to "Euro-box-top" type pillowtop mattresses, which can have several inches of additional padding or cushioning on top of the upper panel of the mattress. However, as a result of the development and offering of the greater variety of styles of mattresses, and because most mattresses generally have, until recently, been manufactured and assembled individually as custom pieces, the manufacture of mattresses, especially pillowtop mattresses, has become more complex and more costly. Further, it is typical for the manufacture of mattresses to be performed in multiple sewing operations conducted at different sewing stations for the assembly and attachment of the various component parts to form each mattress.

FIG. 1 is included to generally illustrate the present state of the art in the manufacture of pillowtop mattresses. It can be seen that as many as twelve separate sewing operations can be required to form and attach the mattress border panel, attachment gusset, flange, and box-top border to the inner panel and frame of the mattress to form a conventional box-top type pillowtop mattress. For example, a mattress 9 is shown in FIG. 1 as including a mattress border 10 that has a gusset portion 11 attached to it at first seam 12, and with a boxtop border 13 being attached to the upper edge of the gusset portion 11 at a second seam 14. The border, gusset, and boxtop initially must be measured and cut to a desired size and their edges sewn in separate operations and thereafter generally must be attached along their side edges along seams 12 and 14 in at least two separate hemming operations, with fire resistant tape 16 being applied over the seams between component edges and then sewn with Kevlar®) thread at a tape edge station in accordance with conventional processes and fire regulations.

The application or wrapping of the fire resistant tape and use of Kevlar® thread for attaching the tape about the exposed edges of the components at the seams therebetween is a requirement to comply with fire regulations in various states. In addition, a cap panel 17 generally will be attached to the lower edge 18 of the mattress border material 10 by another binding tape 19 and Kevlar® thread. Thereafter, the inner panel 21 and flange material 22 of the mattress 9 generally will be attached to the gusset 11 in further, additional sewing operations. It therefore can be seen the prior art methods for forming a mattress typically can require numerous steps in the preparation and attachment of the various components of the mattress, such as the border, gusset and flange material, and the attachment of a pillowtop and/or inner panel of the mattress. In addition, such prior art processes require a substantial amount of relatively expensive materials for their finishing, namely the tape edge material and Kevlar® thread required to sew the tape about the seams of the mattress components.

Accordingly, it can be seen that a need exists for a system and a method for forming various types of mattresses, including box-top pillowtop types of mattresses, which addresses the foregoing and other related and unrelated problems in the art.

SUMMARY OF THE INVENTION

Briefly described, the present invention provides a method and apparatus for making border and attachment gusset portions for a mattress, as well as possibly forming a box-top border for a Euro-type pillowtop mattress, and/or a bottom seam and cap panel attachment portion, from substantially a single piece of material, and thereafter attaching the border and gusset to a mattress panel and possibly to a flanging material as needed to form a mattress. The method and system of the present invention includes multiple passes though a hemming station, which forms one, two, three, or more "faux" seams between the border and attachment gusset material portions along which an inner panel for a mattress and a flanging material will be attached. Additional "faux" seams can be formed to define the boxtop border for a Euro-type pillowtop mattress, and a bottom seam along which a cap panel can be attached. The same roll of border material thus generally will make one or more passes through the hemming station, with the elevation of the sewing components being adjustable between passes of the border material as needed to place a desired number of seams or hems at different elevations in the border material.

Once the integrated border and attachment gusset has been formed in this manner, it can be transferred to a ruffler workstation for forming rounded, ruffled corners in the border corresponding to the corners of the mattress. At the same time, a flanging material can be attached to the attachment gusset for securing the border and the gusset to a spring set for the mattress. The corners further can be marked and a mark can also be applied to denote the ends of a sufficient length of border material for a desired size mattress. Thereafter the ruffled border and gusset material can be cut automatically or by an operator who can then close the cut ends of the border, and possibly attach a panel for the mattress, at an adjacent border closing or sewing station.

The present invention thus eliminates a number of the seams or exposed edges necessarily formed by the connection or attachment of the various mattress components such as the border and attachment gusset, and accordingly eliminates the need for separate tape edge sewing operations along the several attachment locations or seams between the mattress components.

Various objects, features and advantages of the present invention will become apparent to those skilled in the art upon reading the following detailed description, when taken in conjunction with the accompanying drawings.

DETAILED DESCRIPTION OF THE INVENTION

Figure 2:
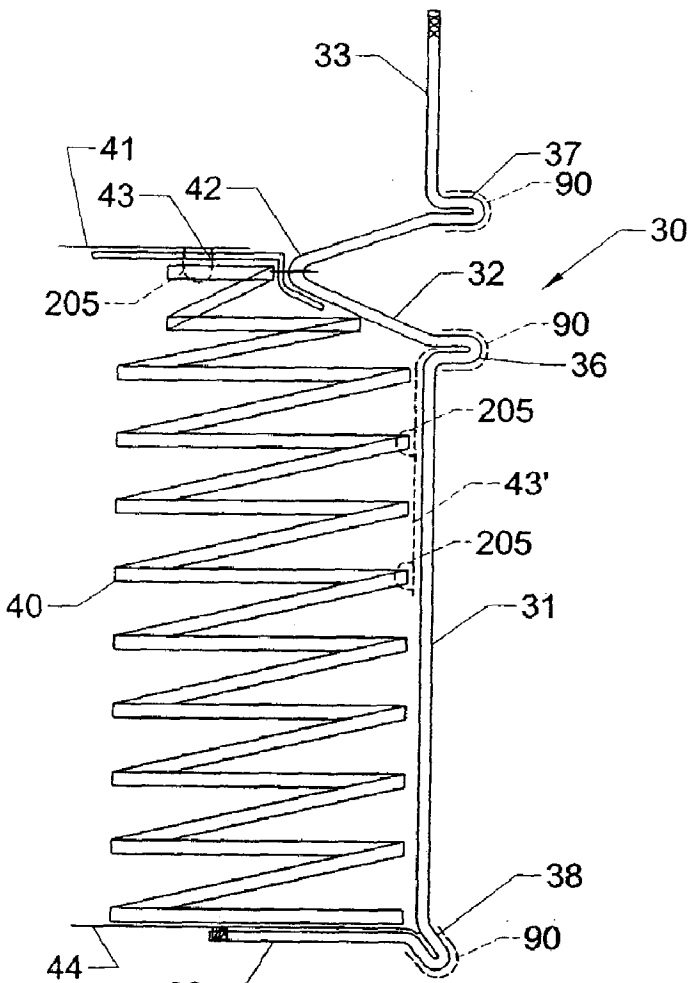
FIG. 2 schematically illustrates a mattress formed with a mattress border with a pillow top attachment gusset and flange material according to the process of the present invention.
Figure 1:
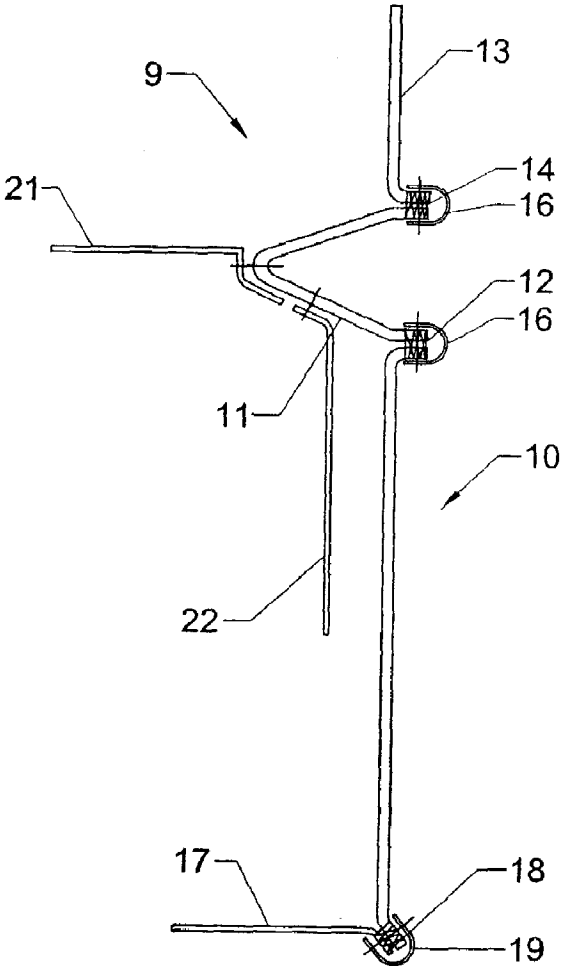
Fig.1 PRIOR ART
FIG. 1 schematically illustrates a box-top type pillowtop mattress formed by a conventional prior art attachment/manufacturing process.

FIG. 2 generally illustrates a mattress 30 formed according to the present invention, including a mattress border 31, attachment gusset 32, and a pillowtop or boxtop border 33, which generally will be made from substantially a single piece of border material. The border material 31 further generally will have been passed through a double edged serger for serging the side edges of the border material, typically with an overlock stitch so as to seal or finish the upper and lower side edges of the border material. As generally illustrated in FIG. 2, the border material 31 further can be formed with one, two or more integral upper "faux" seams 36 and 37, and potentially an integral lower "faux" seam 38, so as to define the pillowtop or boxtop border portion 33, attachment gusset 32, and a bottom or cap panel attachment portion 39 that typically will be tucked and extended under a spring set 40 of the mattress 30. The upper seams 36 and 37 will define between them the pillowtop attachment gusset portion 32 and boxtop border portion 33, which thus will both be formed as an integral part of the mattress border 31. It will also be understood, however, that while three seams 36-38 are shown in FIG. 2, only one seam (i.e., 36 defining the border and attachment gusset) can be formed, or more than three seams can be formed as needed or desired.

In addition, a top or inner panel 41 for the mattress generally can be attached along an inner, folded portion 42 of the gusset 32, with a flange material 43 typically being attached either adjacent the seam 36 (as shown in dashed lines 43') or along folded portion 42 for attachment of the mattress components to the spring set 40 in order to finish the construction of the mattress. Similarly, a bottom or cap panel 44 can be attached along the cap panel attachment portion 39. By forming the border, attachment gusset and boxtop border from a single unitary piece of material, the number of sewing operations and the amount of fire resistant binding tapes and Kevlar® thread that must be used can be significantly minimized in accordance with the system and method of the present invention.

Figure 3A:
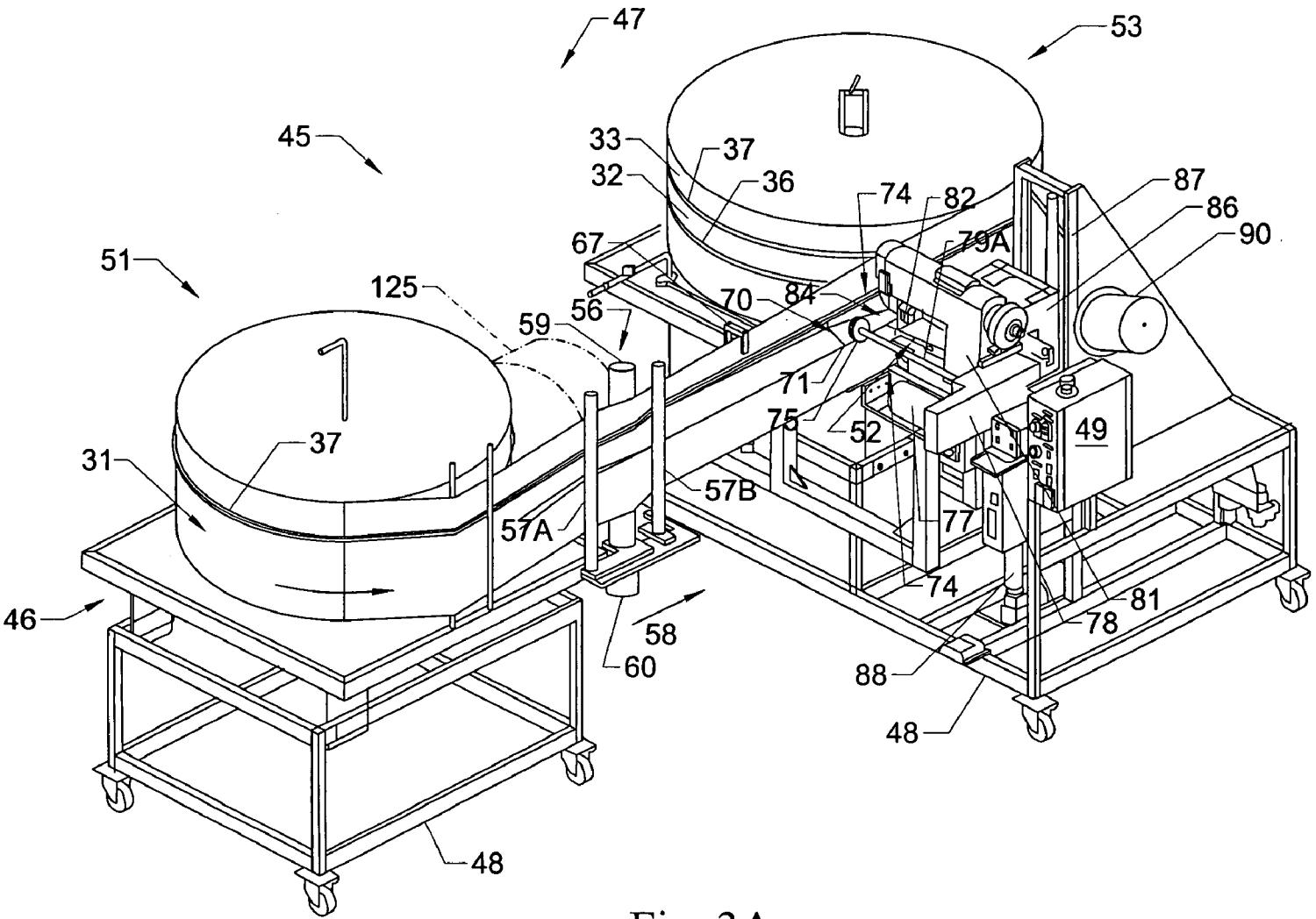
FIGS. 3A-3F are perspective illustrations of the border and attachment gusset hemming and sewing station and component assemblies thereof according to the principles of the present invention.
Figure 3B:
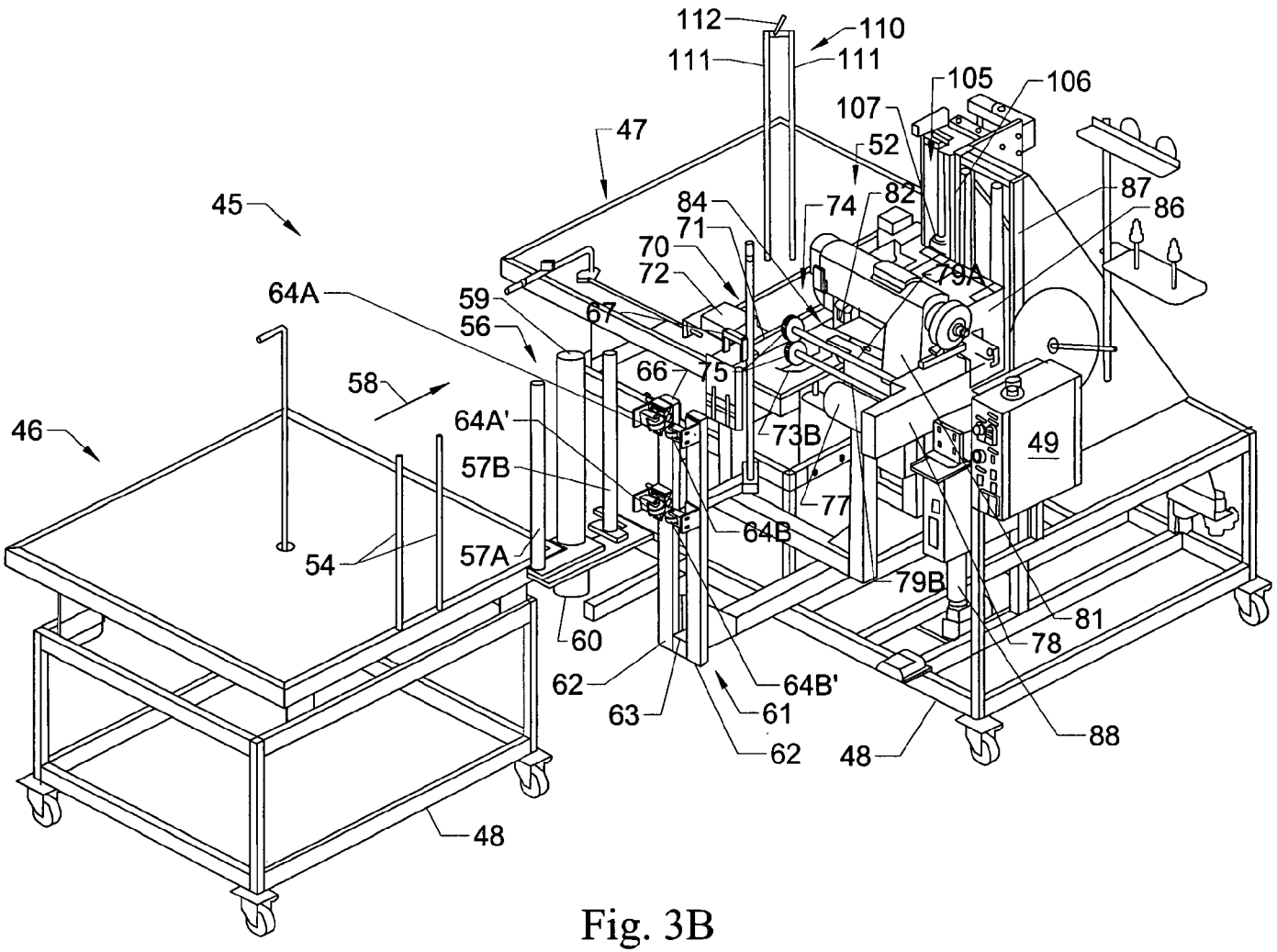

FIGS. 3A-3F generally illustrate the border and gusset forming or hemming station 45 for use in forming the integral mattress border, attachment gusset and boxtop border 31-33 of the mattress 30 of FIG. 2. As generally illustrated in FIGS. 3A and 3B, the hemming station 45 includes an upstream feeding section 46 and a downstream rewinding section 47, each having an adjustable frame 48 and a control system 49. Control system 49 generally includes a programmable processor and can be linked, via a serial bus control system, such as disclosed in U.S. Pat. No. 6,295,481, the disclosure of which is incorporated herein by reference, to a main control system for the overall border, flanging and attachment gusset system of the present invention or to a centralized plant control system or network within the plant or facility in which the border flanging and attachment gusset system of the present invention is used. The upstream feeding section 46 generally supports a feed roll 51 of the border material 31, which border material can be either a plain or quilted material with or without overlock stitching along its finished upper and lower edges. The border material generally is fed from its feed roll 51, substantially without tension, into and through a sewing station 52 for forming the hems or seams 36-38 (FIG. 2) at varying heights or locations across the body of the border material as generally illustrated in FIG. 3A. Thereafter, the border material will be rewound as a finished roll 53 on downstream rewinding section 48.

As illustrated in FIG. 3A, the border material 31 generally is fed or pulled from its supply roll between a series of upstanding guide rods 54, through a tensionless unwinder 56 for feeding the border material into the sewing station 52 substantially without tension thereon. The tensionless unwinder 56 (FIG. 3B) generally includes spaced upstream and downstream idler rolls 57A and 57B, which are oriented in a vertically upstanding alignment along the path of travel 58 for the border material 31 through the hemming station 45. A vertically extending drive roller 59 is positioned between the upstream and downstream idler rolls, and typically has a tacky finish or surface to ensure that it will engage and pull the border material from its feed roll 51 substantially without slippage. The drive roll 59 generally is driven by a drive motor 60, typically positioned beneath the drive roll and generally being driven substantially continuously by its drive motor. As a result, the drive roll tends to substantially continuously pull the border material from its feed roll to provide the border material in a slack, substantially untensioned condition as it is fed into and through the sewing station 52 for forming the seams or hems therein so as to avoid bunching or puckering of the seams due to a later release of tension on the border material.

Figure 3C:
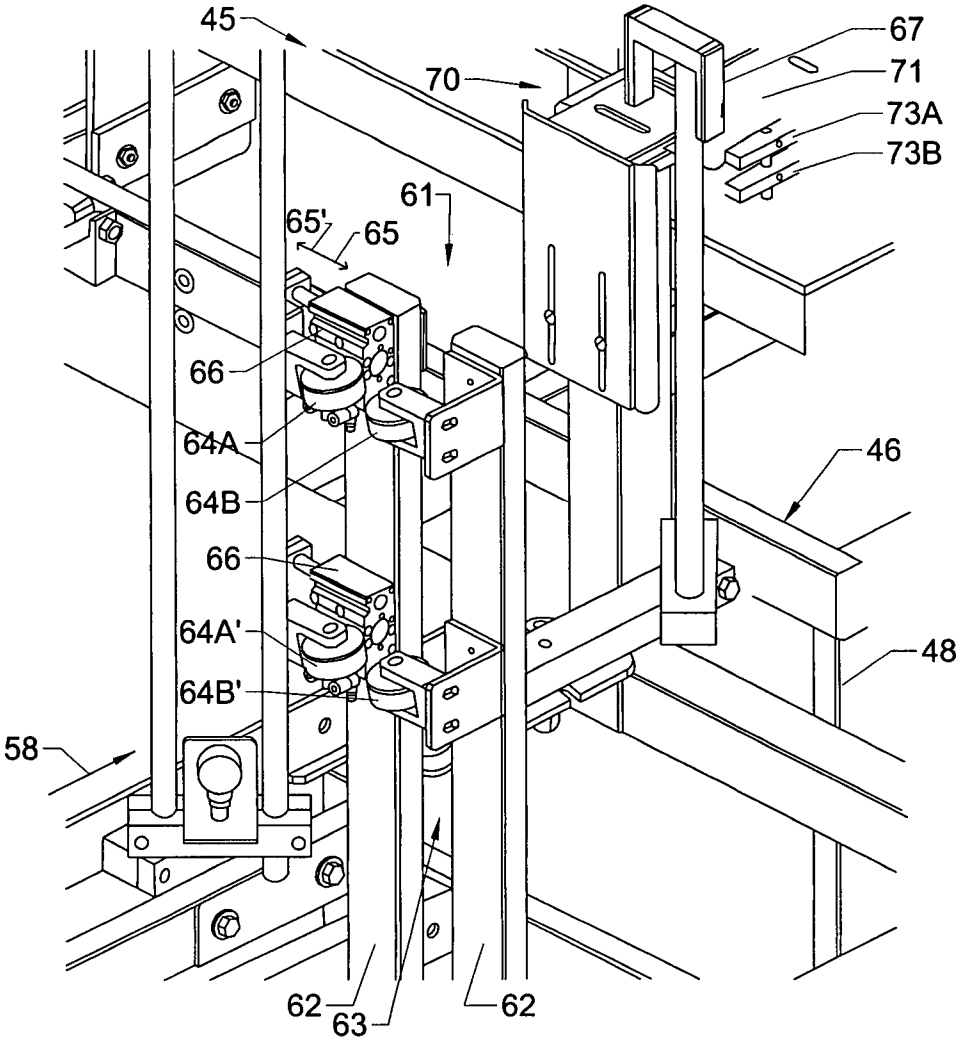

As additionally shown in FIGS. 3B-3C, as the border material is being fed to the sewing station 52, the border material passes through a front guide mechanism 61. The front guide mechanism 61 generally includes a pair of vertically extending supports 62 (FIGS. 3B and 3C) that are spaced apart so as to define a guide channel 63 through which the border material will be passed as it is fed from the upstream feed section 46 to the sewing station 52. Pairs of front guide rollers 64A and 64B and 64A' and 64B' are mounted near the top of the vertical supports 62, with the height or vertical position of the front guide rollers being adjustable as needed to accommodate varying sizes or heights of the border material. The upper pair of front guide rollers 64A and 64B typically are oriented at an upwardly extending angle, while the lower pair of guide rollers 64A' and 64B' typically are oriented downwardly. The pairs of guide rollers engage and pull the border material upwardly (64A/64B) or downwardly (64A'/64B') as needed to adjust the position of the border material for folding and hemming. At least one of the rollers, i.e., 64A and 64A' of each pair of guide rollers, is mounted to an actuator 66, such as a pneumatic or hydraulic cylinder, servomotor, or similar drive mechanism, which moves its front guide roller 64A/64A' toward and away from guide roller 64B/64B', as indicated by arrows 65 and 65' (FIG. 3C), for engagement of the border material 31 therebetween.

An edge sensor 67 (FIG. 3C) is positioned adjacent the vertical supports 62, above the top or upper pair of front guide rollers 64A and 64B, in a position so as to receive the border material as the border material is being fed into the sewing station. The edge sensor 67 generally comprises a substantially U-shaped proximity sensor, although other types of sensors also can be used, such as photocells, laser eyes or other, similar detecting or sensing devices, for detecting the presence or absence of the border material, i.e., as it sags or drops or is moved too far upwardly during the feeding, and signaling the control system 49. For example, if the border material sags or drops such that it uncovers the sensor 67 or is raised too much by guide rollers 64A and 64B so as to contact or cover sensor 67, the sensor will send a signal to the control system, in response to which, front guide rollers 64A and 64B or 64A' and 64B' are moved together into a closed position by their respective actuators 66 so that the border material is engaged and captured therebetween. The guide rollers rotate as the border material is fed therebetween, causing the border material to be urged upwardly to a raised position or downwardly to a lowered position as measured by the edge sensor 67, which will then cause cause the guide rollers to be moved to their open position to allow the border material to be fed free from engagement therewith, so as to substantially maintain the border material in a desired orientation and elevation for feeding to the sewing station.

Figure 3D:
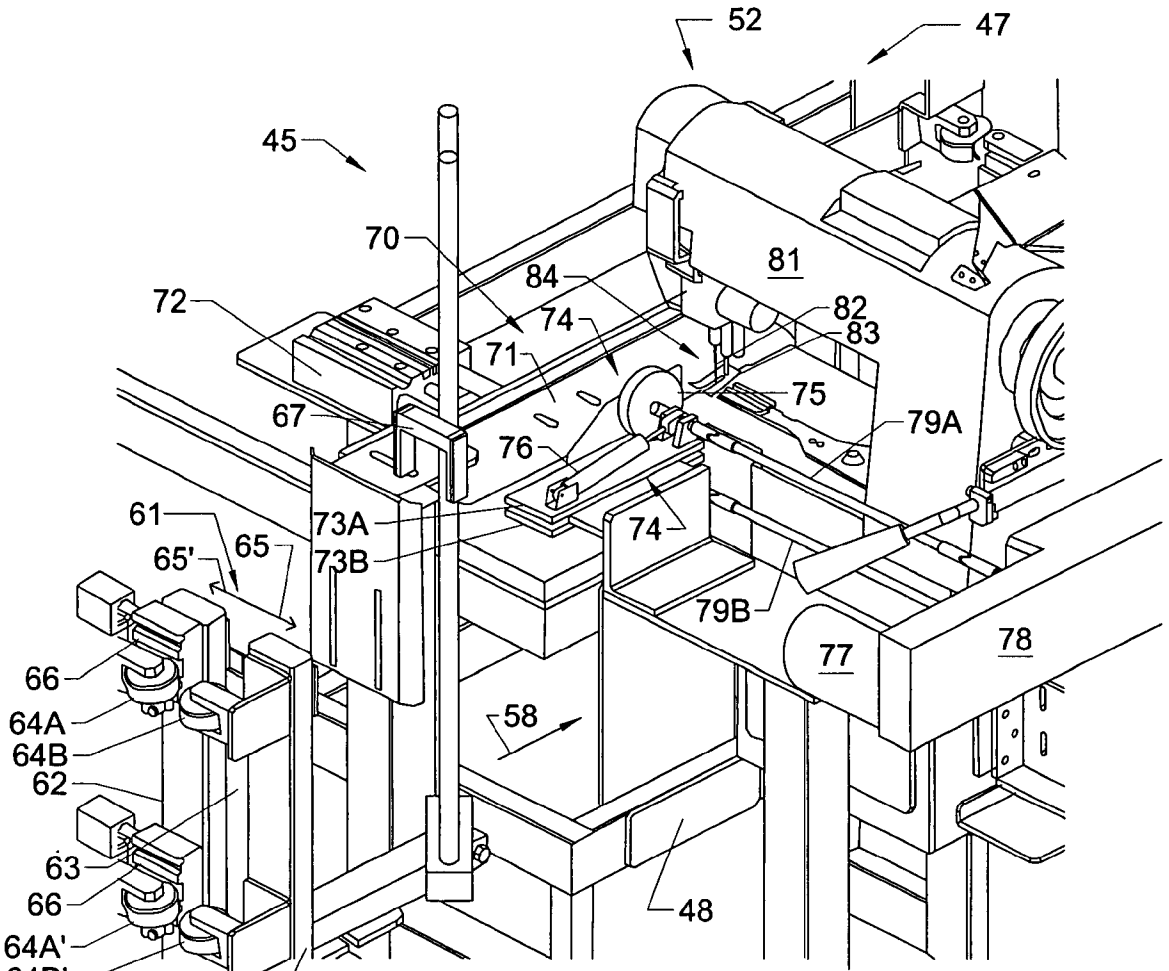

Prior to the feeding of the border material into the sewing station 52, the border material generally will be passed through a folder assembly 70 (FIGS. 3B and 3D) for engaging and forming a fold in the border material as it enters the sewing station, along which fold the "faux" seam or hem 36, 37 or 38 (FIG. 2) will be formed, as indicated in FIG. 3A. As shown in FIGS. 3B-3D, the folder assembly 70 generally includes a folder blade 71 mounted to an actuator 72, such as an air cylinder, drive motor or similar actuator, which will move the folder blade 71 across the path of travel of the border material, into engagement with the border material. The folder blade 71 will urge the border material between a pair of vertically adjustable guide plates 73A and 73B, between which the folded border material is passed as it moves into the sewing station. Typically, the folder blade will project laterally across the path of travel of the border material by a distance sufficient to form a hem or seam or a desired thickness and length or size. The guide plates 73A and 73B generally are part of a synchronized feeder 74 and will be adjustable vertically to accommodate varying widths and thicknesses of border material, so as to substantially trap the border material therebetween to maintain a consistent and even seam margin with respect to the fold in the border material.

Figure 3E:
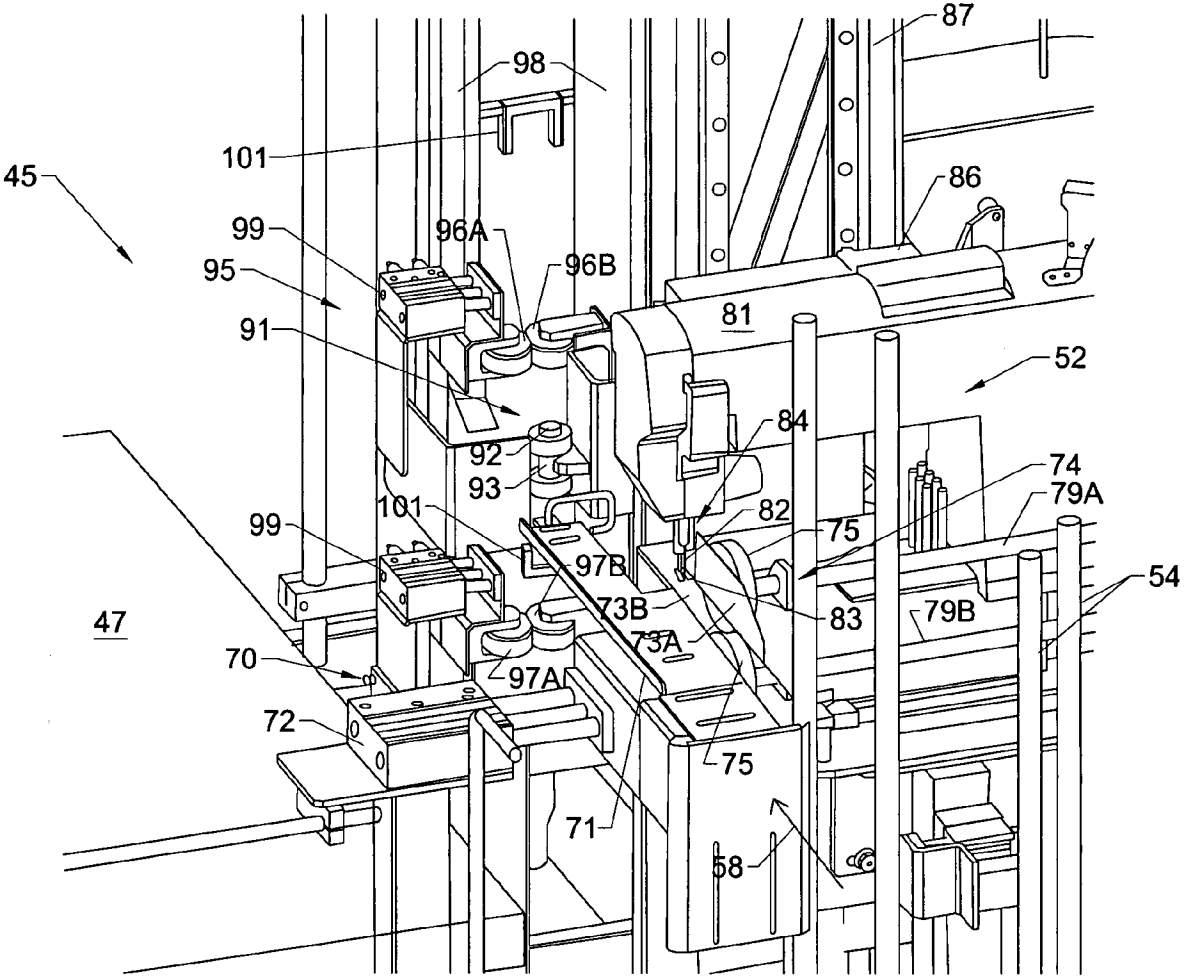

As illustrated in FIGS. 3B, 3D, and 3E the synchronized feeder 74 further generally will include a pair of upper and lower drive or feed wheels 75 that are moved and maintained in driving or engaging contact with the upper and lower sides or portions of the fold or seam portion of the border between plates 73A and 73B (FIG. 3D) material by cylinders 76 (only one of which is shown), the actuation of which is controlled by the control system of the hemming station. In addition, both drive wheels 75 are driven by a drive motor 77 that drives a drive assembly or gear box 78, to which the drive wheels are connected by linkages 79A and 79B. The operation of the synchronized feeder 74 feeds the substantially untensioned border material into sewing station as generally indicated in FIGS. 3C and 3D for sewing the seams or hems 36-38 (FIG. 2).

As shown in FIGS. 3B, 3D, and 3E, the sewing station 52 generally includes a sewing head 81, which typically is a chainstitch sewing head having a needle 82 and a presser foot 83 that define a sewing area 84 through which the folded border material is passed for forming the faux seams or hems therein. The sewing head 81 generally is mounted on an adjustable support bracket 86 that is moveable along a vertically extending track 87. As a result, the height of the sewing head of the sewing station with respect to the border material can be adjusted as needed, depending upon the width or size of the border material and the desired locations of the seams being formed therein. The movement of the sewing head typically will be controlled by an air cylinder 88 (FIG. 3B), although servomotors or other similar actuators also can be used, so as to move the sewing head to its desired height or orientation. The support bracket or frame for the sewing head further can be attached or connected to the base or support for the front guide mechanism 61 for controlling the vertical movement of the front guide mechanism in accordance with the vertical adjustment of the sewing head.

As shown in FIG. 3A, the hemming station 45 also can include a reel of binding tape 90 mounted adjacent the sewing station 52. In some cases, consumers have come to expect tape-finished seams on mattresses they buy, and the provision of the reel of binding tape 90 allows a binding tape to be applied and attached to the hems or seams 36-38 (FIG. 2) that are formed in the border material 31, even though the tape is not necessarily required for borders formed by the present invention. The application of the tape typically is a visual and consumer preference issue and is optional. As is generally illustrated in FIGS. 3A, 3D, and 3E, the binding tape 90 also generally is engaged and pulled with the border material into and through the sewing area 84 of the sewing station 52, typically being folded and/or wrapped and sewn about the fold or seam being formed in the border material.

In FIG. 3E, a seam guide 91 is shown mounted downstream from the sewing area 84 of the sewing station 52. The seam guide generally includes a slotted wheel or roller 92 having a recessed section 93. As the hemmed or seamed border material is passed through the seam guide, the newly formed seam of the border material will pass along the recessed portion 93 of the roller 92, which engages and urges the border material laterally across its sewing path so as to open the hemmed seam of the border material to help keep the border material from being creased or wrinkled as it is rewound on the downstream rewinding section 48 of the hemming station 45 (FIGS. 3A and 3B). If the seam is not opened, it is possible that the border material could be wrinkled or creased as it is wound onto the finished border roll 53. The seam guide 91 (FIG. 3E) further generally is mountable on the moveable support bracket or frame 86 for the sewing station 52 so as to be able to be moveable upwardly and downwardly with the movement of the sewing head to ensure that the just formed seams will be aligned with and will pass through the seam guide for opening so ensure substantially smooth rewinding of the material on the finished border roll.

Figure 3F:
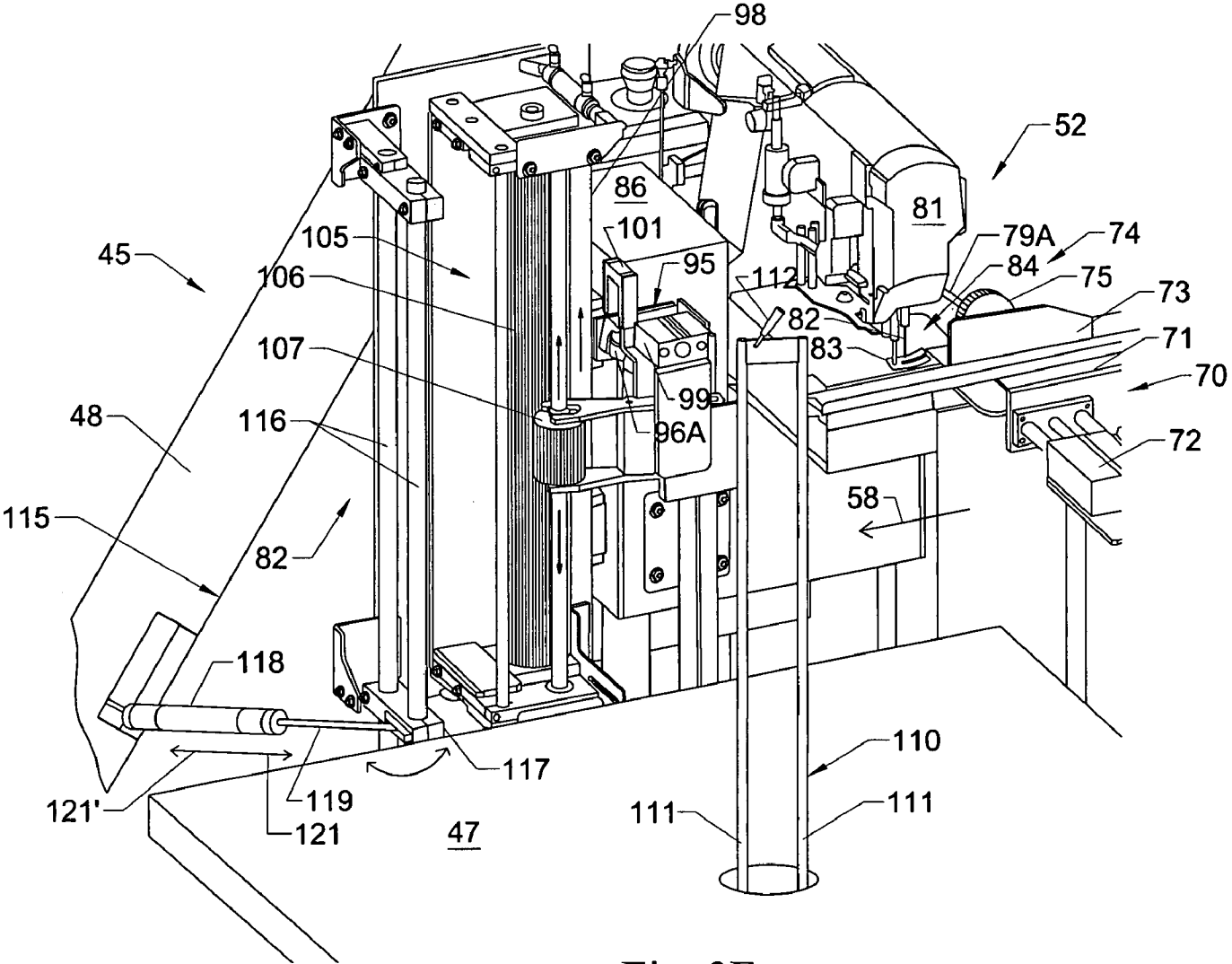

Downstream from the seam guide 91, as shown in FIGS. 3E and 3F, is a rear guide mechanism 95, which includes sets of series of rear guide rollers 96A and 96B and 97A/97B. The rear guide rollers 96A/96B and 97A/97B are similar in construction to and act in much the same manner as the front guide rollers 64A and 64B (FIGS. 3B and 3C), and are mounted on vertically extending supports 98. The rear guide rollers generally will be oriented at an angle, as illustrated in FIGS. 3E, and at least one of the guide rollers, i.e., 96A or 97A, of each set of guide rollers will be mounted to an actuator 99, such as an air cylinder, servomotor or similar actuator, for moving the guide rollers 96A and 97A toward and away from their corresponding guide rollers 96B and 97B to engage the border material therebetween. As the border material passes between the guide rollers, the position of an upper edge of the border material generally is monitored by a sensor 101 (FIG. 3F), mounted above the upper pair of guide rollers 96A/96B. The sensor functions in a similar fashion to sensor 67 (FIG. 3C), to monitor or detect the position of the upper edge of the border material and signals the control system of the hemming station to operate the upper and lower pairs of rear guide rollers to help maintain the border material in a desired orientation or location for smooth rewinding of the hemmed border material.

As shown in FIG. 3F, a material puller 105 is positioned downstream from the sewing station 52 for engaging and pulling the border material away from the sewing station. The puller mechanism 105 generally includes a vertically extending material drive roll 106, and one or more smaller, intermediate idler rolls 107, each of which generally has a fluted or toothed construction, although it is also possible to use other types of drive rolls, including rolls having a tacky finish or surface, to provide enhanced gripping or engagement of the border material. The drive roll 106 generally is driven by a drive motor (not shown) and typically is of a length sufficient to allow for a significant variation in the width or size of the border material being sewn. The idler roll 107 typically is mounted on a vertically extending guide rod or support 108 that generally is attached to the support bracket or frame for the sewing head 81 of the sewing station 52. Thus, as the sewing head is moved up and down to form the various seams at different or varying locations across the width of the border material, the idler roll 107 likewise is moved up and down to reposition its vertical location along the length or height of the drive roll 106 for engaging the border material therebetween. The idler roller further typically will be positioned or oriented along at least one of the seams being sewn in the border material so as to engage and pull the border material along the seam to help maintain a consistent seam margin and proper rewinding by the hemming station 45.

As generally illustrated in FIGS. 3A, 3B, and 3F, the downstream rewinding section 48 includes an upstanding rewinder 110 about which a finished roll 53 (FIG. 3A) of the border material 31 is rewound as indicated in FIG. 3A. The rewinder generally will be driven by a drive mechanism such as a motor or similar actuator (not shown) with the rewinder being connected to its drive mechanism by a clutch, which can be engaged or disengaged as needed to control the driving of the rewinder and thus the rate at which the border material is rewound about the rewinder. As is further illustrated in FIGS. 3B and 3F, the rewinder 110, in the embodiment shown, generally includes a pair of parallel, spaced, moveable bars or rods 111 having a locking mechanism 112 at their upper ends. The locking mechanism fixes the rods 111 in a spaced apart, engaged configuration or first position about which the finished roll of border material will be wound. When it is necessary to remove the border material therefrom, either for a further hemming operation or for transfer to the ruffler station downstream, the locking mechanism can be disengaged. This allows the rods to collapse or move toward each other to a disengaged or second position so as to release tension from the finished roll of border material and enable the easy removal of the finished roll from the rewinder.

In addition, as indicated in FIG. 3F, a tension control mechanism 115 is provided adjacent the rewinding section 48 of the hemming station, positioned along the path of travel of the border material. The tension control mechanism includes an upstanding guide rod 116 about which the border material is passed, and which is mounted to a pivoting support plate 117, so as to be pivotable toward and away from the path of travel of the border material. A control cylinder 118 is mounted on the frame 46 of the hemming station and includes a cylinder rod or arm 119 that connects to the pivoting support plate 117 of the guide rod 116. As the border material is rewound about the rewinder 110, the border material will pass about and tend to bear against the guide rod 116 as the support reel is driven/rotated. If the tension in the border material between the sewing station and the rewinder exceeds a predetermined level, the border material will tend to pull against the pressure of the control cylinder 118, causing its control arm 119 to be extended or pulled therefrom as indicated by arrow 121. In response, a signal is sent to the control system of the hemming station, or alternatively can be sent directly to the drive motor for the rewinder, to cause the clutch mechanism for the rewinder to be disengaged so that the rewinder will stop affirmatively rewinding the border material thereabout until sufficient slack has returned to the border material, as detected by the cylinder and control arm of the tension control mechanism (shown by arrow 121'), to enable the clutch to be re-engaged for continued operation of the rewinder. As a result, the border material will be rewound about the rewinder in a slackened or loose condition that will enable easier removal of the finished roll of border material for transfer either back to the feeding section 46 (FIGS. 3A and 3B) for a subsequent hemming or seaming operation as needed or desired, or to the downstream ruffling station 150 (FIG. 4) for further sewing operations as discussed in more detail below.

Figure 4:
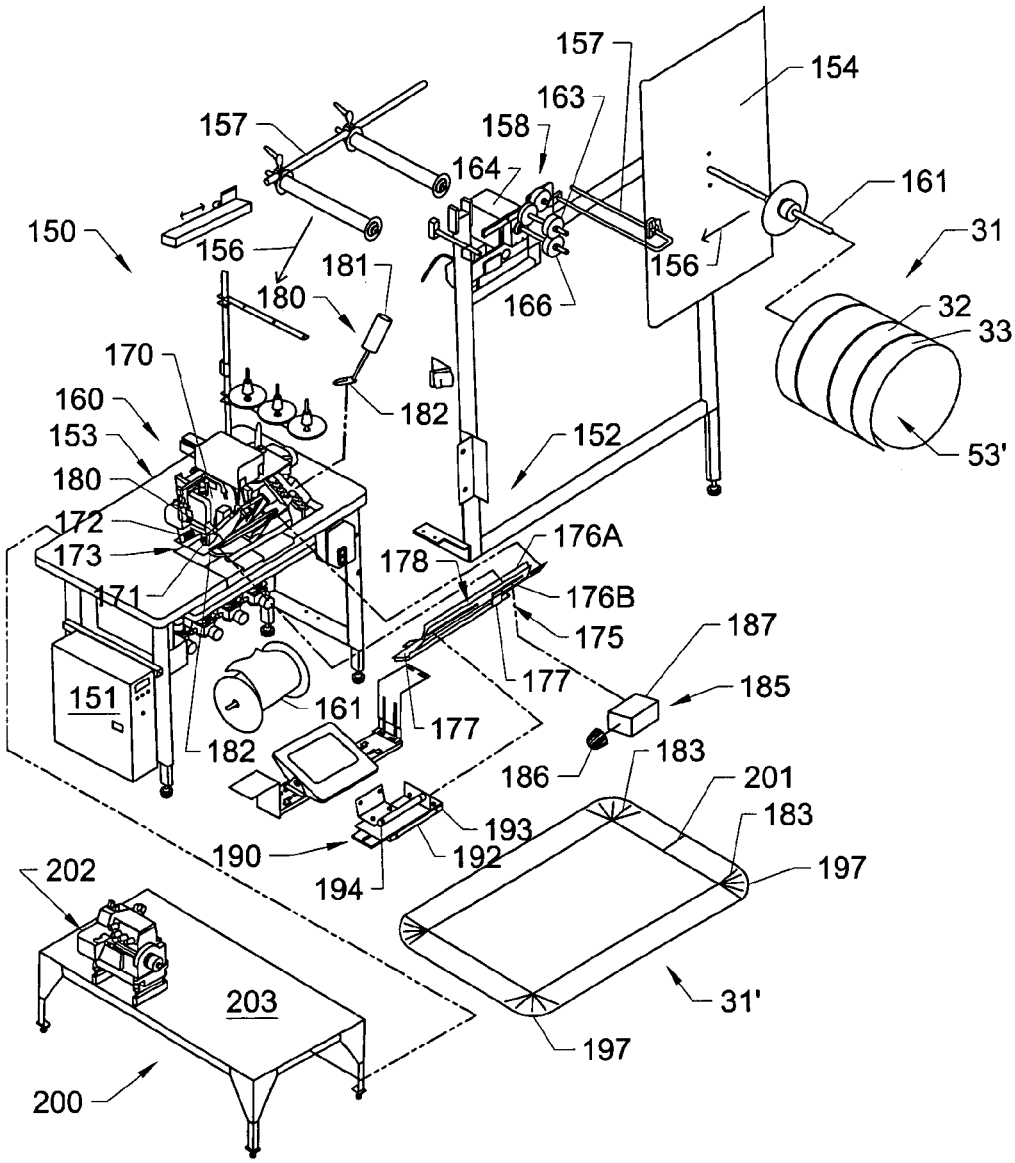
FIG. 4 is an exploded perspective illustration of a ruffling and corner sewing station.

As further generally illustrated in FIG. 3A, it is also possible with the hemming station 45 of the present invention to apply the flange material 43, which will generally be fed from a supply roll indicated by dashed lines 125, to the border material as "faux" seam 36 is formed in the border material. The flange material will be fed from its supply reel into the folder mechanism, which will insert the flanging material into the seam 36, as indicated by dashed lines 43 in FIG. 2. Thereafter, as the seam 36 is sewn in the border material by the sewing station, the flange material also will be attached to the border material along the seam 36, with the border material hanging downwardly along the width of the border section for attachment to the spring set as indicated in FIG. 2. Alternatively, as discussed in more detail below, the flange material can be applied to the attachment gusset by the downstream ruffler station 150, as illustrated in FIG. 4.

In operation of the border and gusset forming station 45 (FIG. 3A) of the present invention, a roll 51 of the border material 31 is loaded onto the upstream feeding station 46 and fed through a tensionless rewinder 56 and front edge guide mechanism 61 (FIG. 3B) into the sewing station 52. In general, the edges of the border material 31 typically will have been serged through a double serging process so as to overlock or serge the upper and lower edges of the border material in an initial pre-hemming step or operation. The roll 51 (FIG. 3A) of serged border material is run through the system for at least a first hemming operation in which a fold is formed in the material adjacent an upper portion of the material by engagement with the folder, along which fold a first "faux" seam or hem is sewn by the sewing head of the sewing station to define the border and attachment gusset. It is then collected by the downstream rewinding station 48 after having passed through the seam guide and the rear edge guide rollers for rewinding as a hemmed or finished roll of border material. Once the entire length of material from the feed roll of material has been passed through the system and collected as a finished roll on the downstream re-winder, the roll of hemmed material can be removed and placed back on the upstream feeding section 47 for at least a second pass or hemming operation through the system. The border material can be passed through the border and gusset forming station 45 (FIG. 3A) one or more times to form a mattress border 31, a box-top border portion 33, and an attachment gusset 32 from a substantially single section or length of material for forming pillowtop mattresses, and in particular, "Euro" type pillowtop mattresses.

As indicated in FIG. 2, the border material can be passed through the system one, two, or three times, although additional passes may be made to form additional seams as needed or desired. During each pass through the system, the material will be folded and sewn along the fold to form a hem or seam that will be sewn into the material as it is passed through the sewing station to form the "faux" seams 36, 37 and 38 defining the border, gusset, and boxtop borders portions in the material. A binding tape 90 (FIG. 3A) from a binding tape reel also can be applied about the hems or seams if necessary. However, since the border, attachment gusset, and box-top border are all being formed from the same piece of border material, there are no exposed edges between the various mattress components. Thus, application of a binding tape over the hem or seams is not necessarily required in order to meet state and federal fire regulations regarding mattresses. Further, with the present invention, the use of Kevlar® thread to attach the binding tape to seal the seams is not required.

Additionally, for a second or additional hemming or seaming operation, the position of the folder and the sewing station can be adjusted as needed to form the attachment gusset and/or boxtop border of a desired width. As the hemmed material passes through the sewing station on the second pass, the folder engages the material at a different location in the same manner as in the first pass. As previously noted, a binding tape may be added from the binding tape reel if desired, although it is not necessarily required. After the completion of a second pass of the border material through the system, the border material will generally have formed in it upper seam 36, defining the border 31, gusset 32, and potentially seam 37 defining a box-top border 33 for a mattress. The material 46 further can be passed through the system for a third time to form a lower seam 38 (FIG. 2) if desired.

After a desired number of seams have been formed in the border material, the finished roll of border material will be transferred to a ruffler station 150, such as an Atlanta Attachment Company Model 1335MF Gusset Ruffler Workstation, as generally shown in FIG. 4 and in Applicants' co-pending U.S. patent application Ser. No. 10/774,035, filed Feb. 6, 2004, the disclosure of which is incorporated by reference. The ruffler station 150 is controlled automatically by a control system 151 that generally comprises a serial bus control system, such as that disclosed in U.S. Pat. No. 6,295,481, the disclosure of which is hereby incorporated by reference.

As shown in FIG. 4, the ruffler station 150 includes an adjustable framework 152 including a table 153 and a support stand 154 on which a roll 53' of hemmed/seamed border material 31 is received for supply to the ruffler station 150. The border and gusset material will be pulled from its roll by an unwinder or pre-feed system 158 and fed along an overhead path, as indicated by arrows 156, over supports 157 and into a sewing station 160 for application of a flange material 43, fed from a supply reel 161, for the gusset and for forming ruffled or pleated corner portions 152 in the border and gusset material. The unwinder or pre-feed system 158 generally includes a drive roller 163 that is driven by a drive motor 164 and an idler roller 166, between which the border material is received and engaged. As the drive roller is rotated or driven by its drive motor 164, the border material will be pulled from its roll 53' for feeding into the sewing station.

As illustrated in FIG. 4, the sewing station 160 generally is mounted on table 153 and includes a sewing head 170 having a sewing needle 171 and a puller mechanism 172, defining a sewing area 173 into which the flanging material 43 is fed and attached to the border and gusset material. An adjustable folder 175 is mounted upstream of the sewing area 173 of the sewing station 160. The folder generally includes a pair of spaced folder plates 176A and 176B and one or more adjustable guide members 177 for adjusting the thickness and/or width of the passage 178 between the folder plates according to the thickness and/or width of the border and gusset material being passed therethrough.

The border material is passed through the folder 175 and is fed into the sewing area 173 of the sewing area 160 for attachment of the flange material 43 to the gusset portion 32 of the border and gusset material as indicated in FIG. 2. As the border and gusset material passes into the sewing area 173, it passes through and is selectively engaged by a ruffler mechanism 180. The ruffler mechanism 180 of the ruffler station 150 is similar in construction and operation to the ruffler mechanism disclosed and claimed in Applicants' co-pending U.S. patent Ser. No. 10/774,035, filed Feb. 6, 2004, the disclosure of which is incorporated herein by reference. As illustrated in FIG. 4, the ruffler mechanism 180 generally includes a cylinder 181 to which a ruffler blade or foot 182 is attached. The cylinder can be selectively or automatically actuated by the control system 151 of the ruffler workstation 150, or manually by an operator, to engage and form a series of ruffles or pleats 183 at desired locations or points along the length of the border material being fed therethrough.

The ruffler workstation 150 further generally includes a metering or length detection mechanism 185 that typically will be mounted adjacent the folder 175. The metering mechanism includes a wheel or roller 186 attached to an encoder 187 or similar measuring device and engages the border material as the border material is being passed through the folder 175. As the wheel 186 is rotated with the feeding of the border material through folder 175, the encoder monitors and reports the rotation of the wheel 186 to thus provide a measurement of the amount of border material being fed into the sewing station. The controller 151 can be programmed to record the revolutions of the metering wheel for measuring or detecting when a desired length of border material has been passed through the sewing station (i.e., a sufficient length for forming a queen-size, king-size, double, or twin mattress). Other types of metering devoices also can be used.

Figure 5A:
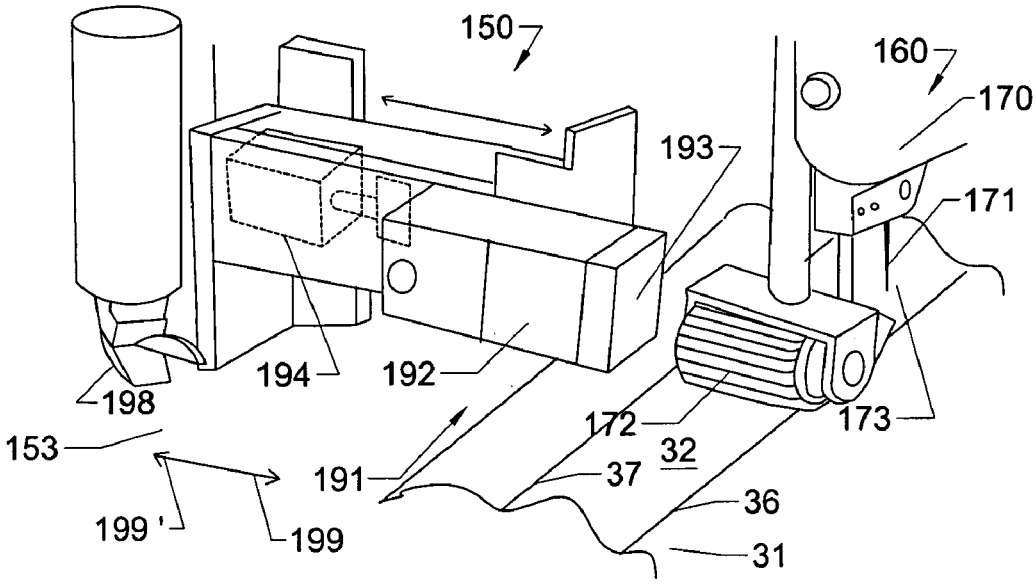
FIGS. 5A and 5B illustrate the use of a marking implement on the ruffler station for marking the length of the border.
Figure 5B:
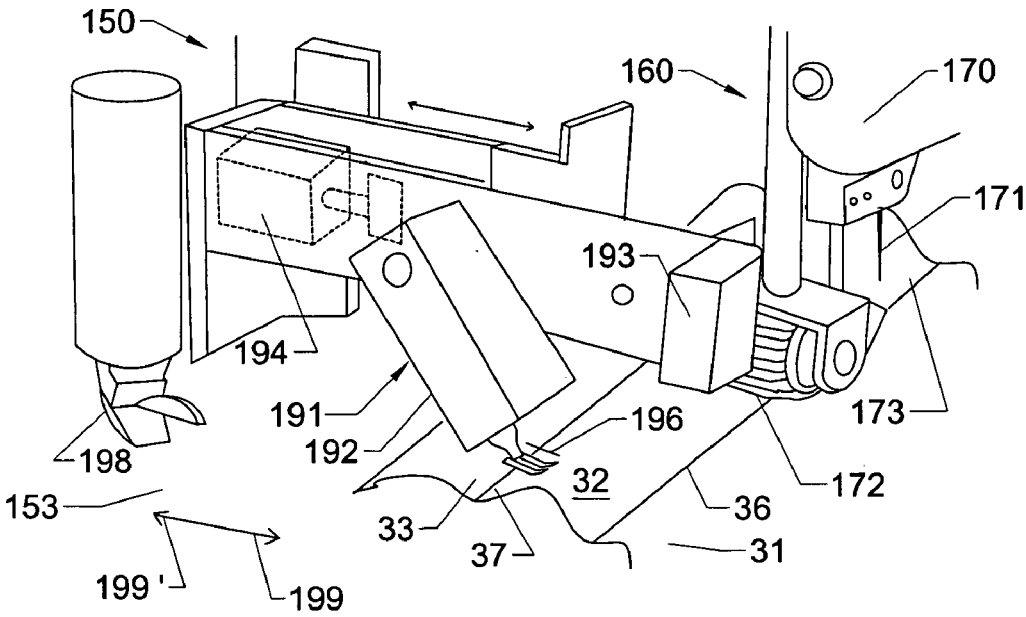

As seen in FIG. 4, the sewing station also generally includes a first marking module 190 mounted along a distal or peripheral side edge of folder 175. The marking module 190 is selectively actuated or controlled by the controller 151 (FIG. 4) of the ruffler station to mark the locations where corners along a bottom edge of the mattress border will be formed. This allows the operation in subsequent operations to readily determine the location at which the corners should be formed. In FIGS. 5A-5B, a second marking module 191 is seen as being placed just after the sewing station 160, for making the length of a completed border. The first and second marking modules 190 (FIG. 4) and 191 (FIGS. 5A and 5B) both generally include a pivoting marker 192, a moveable cover 193 and an actuator 194 for moving the cover 193 from a closed position (FIG. 5A) to an open position (FIG. 5B) to enable pivoting of the marker 192 into contact with the border material after a pre-set length of border material has passed. The actuator 194 may be a cylinder, servomotor, or similar device. The machine controller also can be pre-set for a selected number of borders of a desired size. The actuator of each marking module causes its cover to be extended and the marker 192 to pivot toward the border material 31 so as to place a mark 196 (FIG. 5B) along the border material 31, to assist the operator in the next steps of completing the border and attaching the completed ruffled and flanged border and gusset to an inner or cap panel for a mattress.

The first marking module 190 provides a mark at the point where the border material 31 should be cut to form a completed border 31'. This is, the length of border material required to form a border for various sized mattresses and a desired number of such borders (i.e., 2-7 queen-size borders, etc.) can be programmed and automatically formed by the ruffler station 150, with a mark being placed by the first marking module 190 at each location where the border material should be cut to form each completed, ruffled border, while the second marking module 191 (FIGS. 5A and 5B) provides indicia of where the corners 197 (FIG. 4) of the border 31' should be mitered and sewn to an inner or cap panel for a mattress.

As additionally illustrated in FIGS. 5A and 5B, an automatic cutter 198 optionally can be provided with the ruffler station. The automatic cutter generally will include an electrically or pneumatically driven cutter, such as a rotary cutter, knife or pneumatic scissor mechanism that will be moveable across the path of travel of the border material through the sewing station, as indicated by arrows 199 and 199', for automatic cutting or severing of the border material at a desired, preset length thereof. The movement and actuation of the cutter 198 generally can be automatically controlled by the control system of the ruffler station, or can be controlled manually by the operator, in response to the feeding of a desired preset length of border material into the sewing station.

As further illustrated in FIG. 4, a finished, ruffled border and attachment gusset with the flange material 43 having been attached thereto, thereafter can be transferred to an adjacent or downstream border closing or sewing station 200 for closing or attaching the ends of the border 31 along a seam 201 and/or attaching the mattress border to an inner or cap panel for a mattress as indicated in FIG. 2. The border closing station 200 typically will include an overlock sewing machine or similar type of sewing head 202, typically mounted on a table 203, that can include an air table. As further indicated in FIG. 4, the closing station can be included with the ruffler station 150, with its table 203 being attached to or adjacent the table 153 of the ruffler station so that the operator can move a completed, ruffled and flanged border and gusset directly from the ruffler station to the closing station to enable the single operator to perform multiple sewing operations for finishing and closing the border and possibly attaching it to an inner or cap panel for a mattress, rather than transporting the cut, ruffled borders to a downstream workstation(s) for such sewing operations.

Thereafter, as illustrated in FIG. 2, the border 31 with integrally formed attachment gusset 32, and possibly a boxtop border 33 as well, can be attached to the spring set 41 of a mattress 30. Typically, the flanging material 43 will be attached to one of the springs of the mattress spring set, here generally being illustrated as being attached by a hog ring or staple 205 to an upper ring or portion of a spring of the spring set, although it is also possible to attach the flanging material along the sides of the springs as indicated by dashed lines 43' and 205' in FIG. 2. However, with the ruffled borders formed according to the present invention, the flange material can be applied to the top of the mattress springs, which are generally easier to access and attach the flanging material thereto. Thereafter, the inner panel 41 can be added, as needed or desired, over the spring set such as by sewing to the attachment gusset or by stapling or hog ringing the inner panel with the flanging material to the upper ring of the spring in a single operation to permit more efficient manufacture of the mattresses.

It can accordingly be seen that the present invention provides a significant reduction in the number of operations required to form pillowtop mattresses, and in particular, boxtop type pillowtop mattresses, as well as reducing the requirement for the use of binding tapes and expensive Kevlar® thread at the seams between the mattress components. This also reduces the overall cost of making the mattress. Additionally, it will be understood that the present invention also can be used to form other types of mattress borders, including continental and conventional pillowtop type mattress borders with a pillowtop attachment gusset integrally formed therewith, essentially formed from a unitary piece of material at a single or reduced number of sewing stations. This further reduces the number of sewing operations required to form the different type of mattress borders.

It will be further understood by those skilled in the art that while the present invention has been described above with reference to preferred embodiments, various changes, modifications, and variations can be made thereto without departing from the spirit and scope of the invention.

The invention claimed is:

1. Apparatus for forming a one-piece border for a mattress comprising:

a feeding section for providing a length of border material along a substantially vertically oriented path of travel;

a rewinding section downstream from said feeding station for receiving the border material;

a sewing station, including a sewing head, positioned along the path of travel between said feeding and rewinding sections for sewing at least one faux seam in the border material;

a folder blade for folding the border material as the border material moves through said sewing station for sewing said at least one faux seam defining the one-piece border with a gusset portion therein, by said sewing head;

a drive system for moving the border material in a substantially vertical orientation from said feeding section, through said sewing station, and to said rewinding section; and a first active edge guide mechanism, between said feeding section and said sewing station, for maintaining the border material at a substantially fixed vertical elevation relative to said sewing station.

2. The apparatus of claim 1 wherein said first active edge guide mechanism includes:

a pair of vertical supports through which the border material is passed in a substantially vertical orientation;

at least one pair of guide rollers mounted along said vertical supports;

a sensor mounted adjacent said vertical supports along said path of travel of the border material in a position to detect a vertical position of the border material; and an actuator for moving one of said guide rollers into engagement with the border material in response to a signal from said sensor.

3. The apparatus of claim 1 further comprising a second active edge guide mechanism, between said sewing station and said rewinding section, for maintaining the border material at a substantially fixed vertical elevation relative to said sewing station.

4. The apparatus of claim 3 wherein said second active edge guide mechanism:

a pair of vertical supports through which the border material passes;

at least one pair of rollers mounted along said vertical supports;

a sensor mounted adjacent said vertical supports along said path of travel of the border material through said vertical supports, in a position to detect the position of the border material; and an actuator for moving one of said guide rollers into engagement with the border material in response to a signal from said sensor.

5. The apparatus of claim 1 further comprising a substantially vertically oriented tensionless unwinder adjacent said feeding station for feeding a substantially untensioned supply of the border material to said sewing station.

6. The apparatus of claim 5 and wherein said tensionless unwinder comprises at least one idler roll about which the border material is passed and a drive roll for engaging and pulling the border material from said feeding station for supplying the border material to said sewing station with tension in the border material being substantially reduced.

7. The apparatus of claim 1 further comprising a material puller, between said sewing station and said rewinding section, for pulling the border material from said feeding section through said sewing station.

8. The apparatus of claim 7 wherein said material puller includes:

a elongated vertical drive roller, said elongated vertical drive roller being of substantially the same height as the height of the border material;

an idler roller, said idler roller positioned to engage the border material adjacent a hem formed in the border material with border material being trapped between said drive roller and said idler roller; and a guide rod upon which said idler roller is mounted.

9. The apparatus of claim 1 further comprising:

a tension control mechanism including a sensor for monitoring and detecting tension in the border material as the border material is rewound on said rewinding section and controlling the rewinding of the border material to limit tension therein.

10. The apparatus of claim 1 further comprising:

a ruffling station having a sewing station and a ruffler mechanism for placing a series of ruffles in the border material, after hemming of the border material, at locations corresponding to the corners of a border for the mattress.

11. The apparatus of claim 10 further comprising a marker for placing an indicia at the location where each corner will be located in the border to assist an operator in determining the corner locations of the border.

12. The apparatus of claim 10 further comprising:

a reel carrying a supply of flange material, said flange material being fed into said ruffling station and sewn onto a gusset portion of the hemmed border material.

13. The apparatus of claim 10 further comprising:

a cutter for engaging and cutting the border material at a desired length to form the border.

14. The apparatus of claim 13 further comprising:

a second sewing station for closing the perimeter of the border to form a completed mattress border.

15. An apparatus for forming a one-piece border for a mattress comprising:

a feeding section for providing a length of border material along a substantially vertically oriented path of travel;

a rewinding section downstream from said feeding station for receiving the border material;

a sewing station, including a sewing head, positioned along the path of travel between said feeding and rewinding sections for sewing at least one faux seam in the border material;

a folder blade for folding the border material as the border material moves through said sewing station for sewing said at least one faux seam defining the one-piece border with a gusset portion therein, by said sewing head;

a drive system for moving the border material in a substantially vertical orientation from said feeding section, through said sewing station, and to said rewinding section; and an active edge guide mechanism, between said sewing station and said rewinding section, for maintaining the border material at a substantially fixed vertical elevation relative to said sewing station.

16. The apparatus of claim 15, wherein said active edge guide mechanism comprises:

a pair of vertical supports through which the border material passes;

at least one pair of rollers mounted along said vertical supports;

a sensor mounted adjacent said vertical supports along said path of travel of the border material through said vertical supports, in a position to detect the position of the border material; and an actuator for moving one of said guide rollers into engagement with the border material in response to a signal from said sensor.

17. The apparatus of claim 15, further comprising a substantially vertically oriented tensionless unwinder adjacent said feeding station for feeding a substantially untensioned supply of the border material to said sewing station.

18. The apparatus of claim 15, further comprising a material puller, between said sewing station and said rewinding section, for pulling the border material from said feeding section through said sewing station.

* * * * *